United States Patent [19]

Bergstrom

[11] Patent Number: 4,690,250

[45] Date of Patent: Sep. 1, 1987

[54] VEHICLE BENCH LIFT

[75] Inventor: Hans R. Bergstrom, Kungsor, Sweden

[73] Assignee: Car-O-Liner Company, Wixom, Mich.

[21] Appl. No.: 5,234

[22] Filed: Jan. 20, 1987

Related U.S. Application Data

[63] Continuation of Ser. No. 722,739, Sep. 5, 1985, abandoned.

[51] Int. Cl.[4] ..... B66B 11/04

[52] U.S. Cl. ..... 187/18; 182/141; 254/122

[58] Field of Search ..... 187/8.71, 8.72, 18; 254/122, 89 R, 2 R, 2 B, 2 C; 182/141, 63, 69; 52/109

[56] References Cited

U.S. PATENT DOCUMENTS 3,246,876 4/1966 Larson ..... 187/18

4,221,280 9/1980 Richards ..... 187/18

*Primary Examiner*—H. Grant Skaggs

*Assistant Examiner*—Kenneth Noland

*Attorney, Agent, or Firm*—Barnes, Kisselle, Raisch, Choate, Whittemore & Hulbert

[57] ABSTRACT

A portable lift for the bench frame of a vehicle measuring, bending and aligning system with two pairs of pivotally interconnected arms driven by a pair of fluid actuated cylinders, all of which are carried by a base and when fully lowered received between longitudinal rails of the bench frame. Preferably, the lift is operated by a portable and remote power and control unit. Preferably, when raised, the lift is prevented from suddenly dropping to the fully lowered position in the event of a failure or malfunction of the drive cylinders or power unit by a catch mechanism disposed between the arms of the lift.

11 Claims, 13 Drawing Figures

VEHICLE BENCH LIFT

This is a continuation of co-pending application Ser. No. 772,739 filed on Sept. 5, 1985 now abandoned.

FIELD OF THE INVENTION

This invention relates to lift mechanisms, and more particularly to a lift for vehicle bench systems.

BACKGROUND OF THE INVENTION

Various bench systems for underlying and supporting vehicles, such as cars and trucks, so that their bodies can be measured, drawn, aligned and repaired are known and one such system is disclosed in U.S. Pat. No. 4,366,624. These systems utilize a bench or very strong frame with laterally spaced apart rails on which a vehicle body is mounted and supported. Various fixtures, tools and drawing devices can be attached to the bench for use in measuring various points on the body, drawing or bending damaged portions of the body and/or vehicle frame to correctly realign the damaged portions, supporting new parts while they are secured to the vehicle, etc. Frequently, it is necessary to lift a bench with a vehicle thereon above the floor to position the bench and/or portions of the vehicle at a desired working height. Usually, this is done manually with extra jacks, hoists, blocks and the like.

SUMMARY OF THE INVENTION

In brief, this invention is a compact lift for a bench system with pairs of pivoted lift arms and drive cylinders which when fully lowered are received between the frame rails of the bench. Preferably, the cylinders are powered and the lift controlled by a portable power or prime mover unit. When the lift is raised, a catch mechanism prevents it from being completely lowered in the event of a failure or malfunction of the power unit or the drive cylinders.

Objects, features and advantages of this invention are to provide a lift for a bench system which is compact, does not utilize any floor mounting pit or structure, easily movable from one location to another, is usable with existing bench frames, will not be completely lowered in the event the drive cylinders or power unit fail, is very stable, rugged and durable, of simplified design and assembly, and requires little service and maintenance in use.

BRIEF DESCRIPTION OF THE DRAWINGS

These and other objects, features and advantages of this invention will be apparent from the following detailed description, appended claims and accompanying drawings in which:

DETAILED DESCRIPTION OF THE INVENTION

Figure 1:
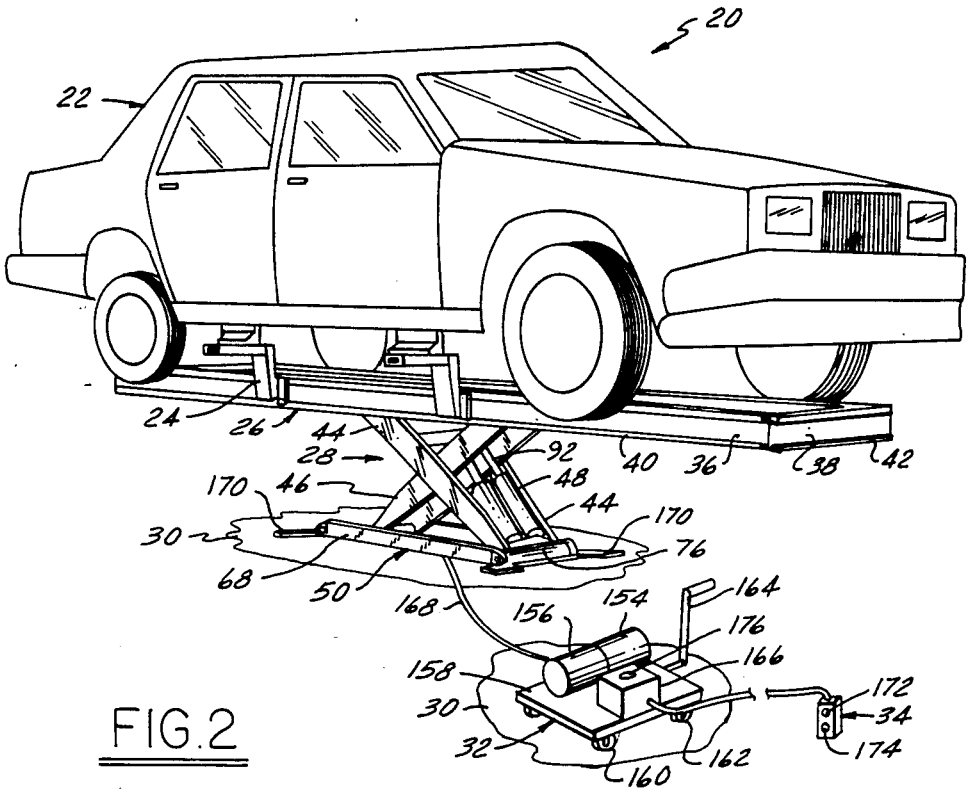
FIG. 1 is a perspective view of a vehicle mounted on a frame of a bench system which is fully raised and supported by a lift embodying this invention.
Figure 2:
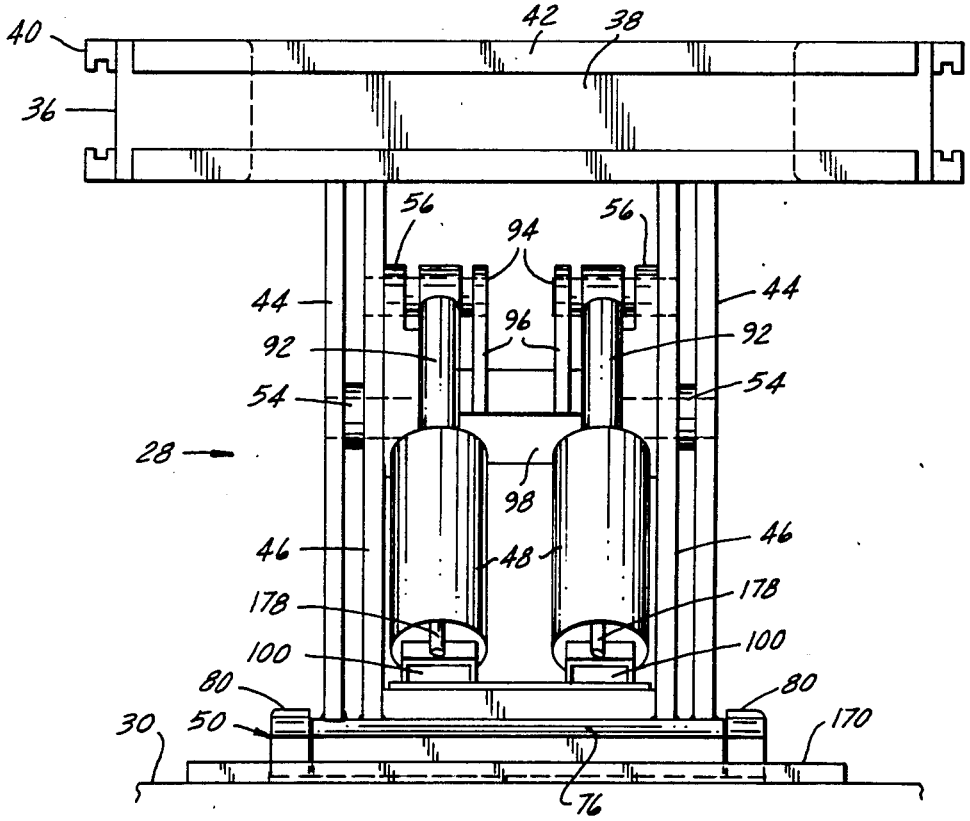
FIG. 2 is an end view of the lift and bench frame of FIG. 1.

Referring in more detail to the drawing, FIG. 1 illustrates a car 20 with a unitized body 22 mounted by clamps 24 on a frame 26 of a bench system which is raised and supported by a lift 28 embodying this invention received on a generally flat floor 30 of a vehicle repair facility. The lift is powered by a preferably portable prime mover unit 32 with a remote control box 34. Typically, the bench frame 26 has rigid tubular steel longitudinal rails 36 welded to cross members 38 to which tracks 40 and 42 are fixed for mounting and positioning clamps, fixtures, tools, part holders, measuring devices, drawing and pulling devices, and the like for measuring, bending, aligning, repairing and replacing various parts and components of the body.

Figure 3:
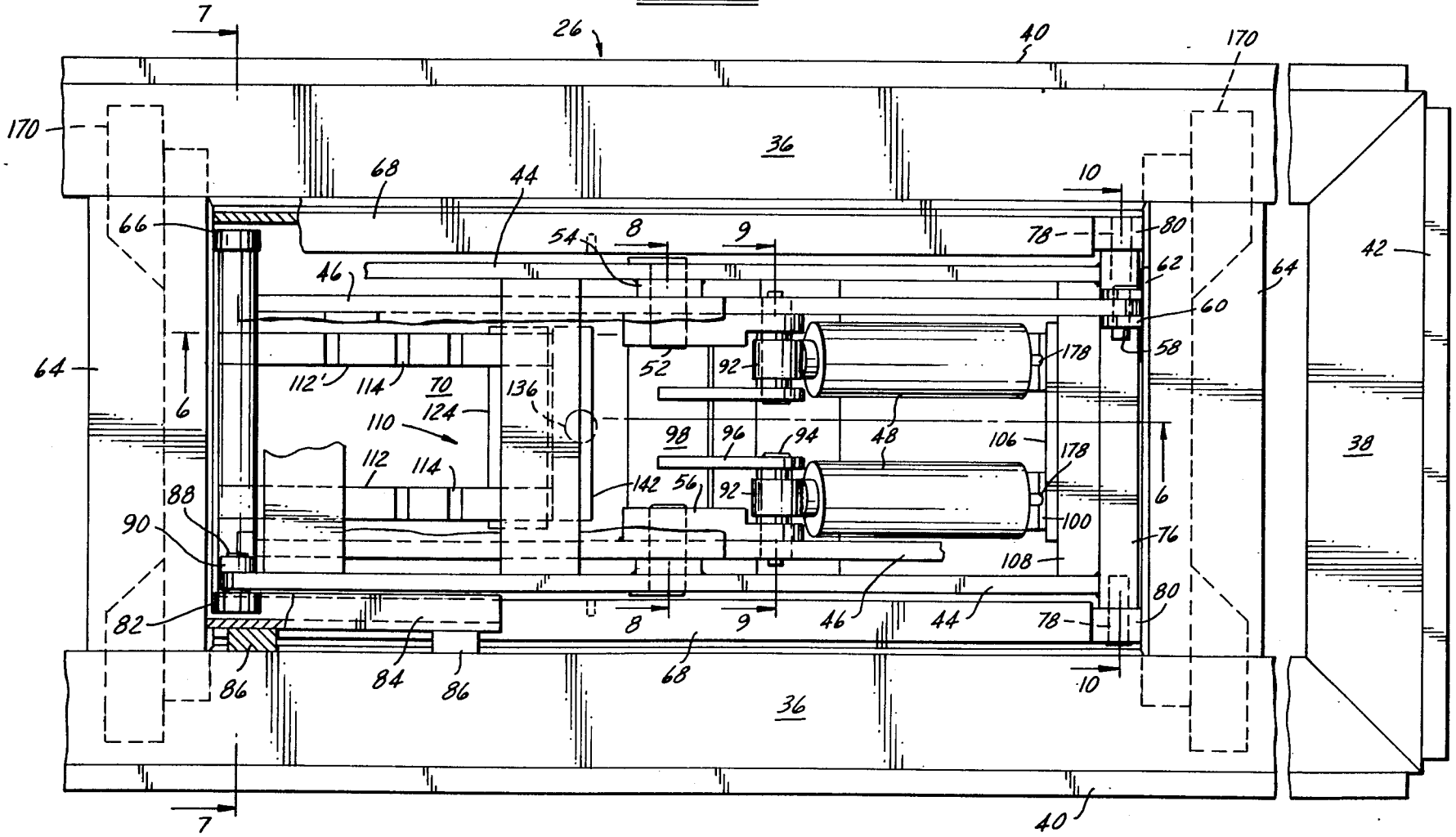
FIG. 3 is a fragmentary top view with portions broken away of the bench frame and lift in the fully lowered position.
Figures 4, 5:
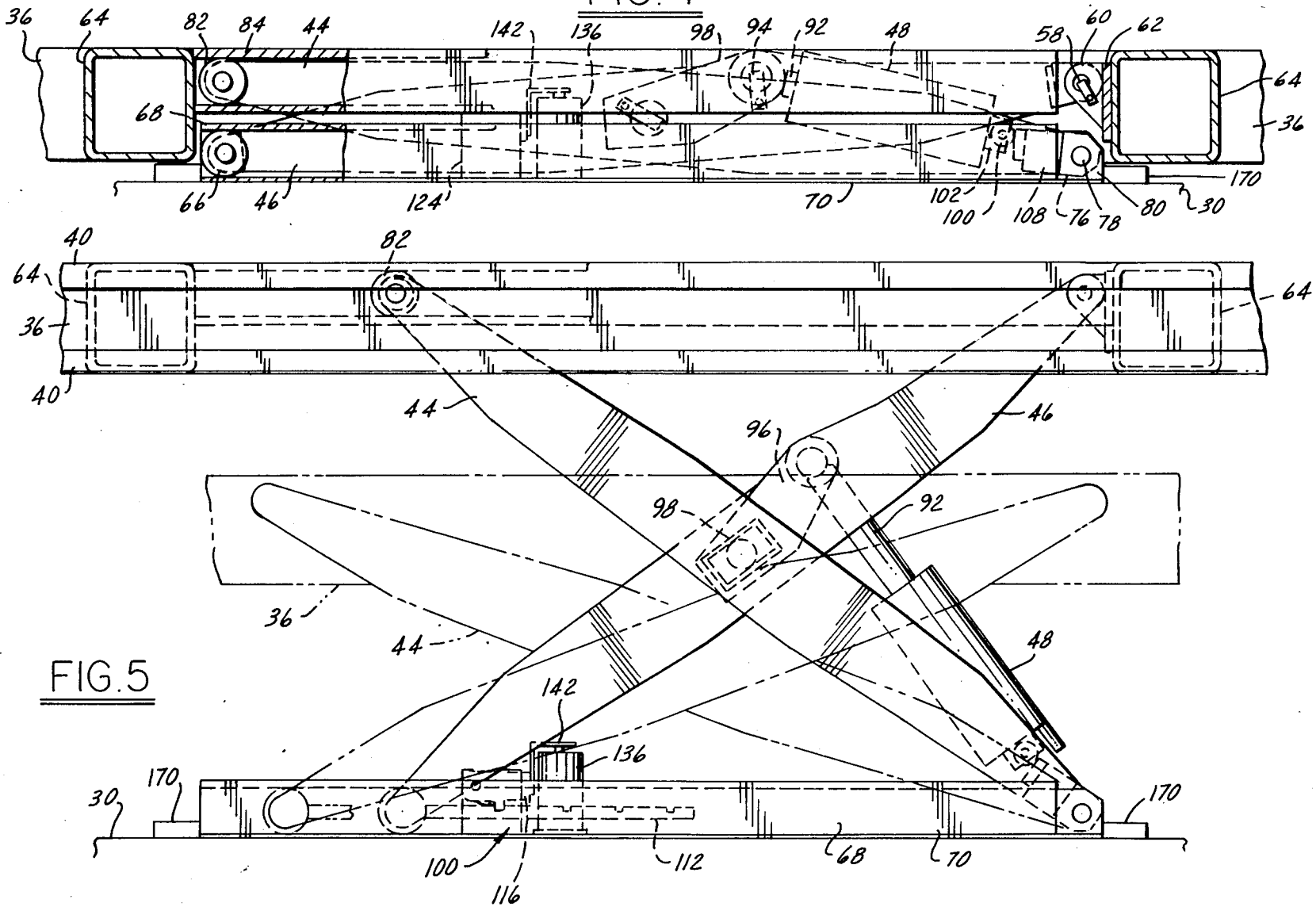
FIG. 4 is a fragmentary side view with portions broken away of the bench frame and lift in the fully lowered position.
FIG. 5 is a fragmentary side view of the bench frame and lift showing the fully raised position in solid lines and an intermediate position in broken lines.

In accordance with one feature of this invention, as shown in FIGS. 3 and 4, the lift 28 when fully lowered is received between the rails 36 of the bench frame and does not project vertically substantially above the upper face of the bench frame. The bench frame is raised and lowered by the cooperation of a pair of outer arms 44 and inner arms 46 driven by a pair of hydraulic cylinders 48 all of which are carried by a base 50.

In accorance with this invention, to provide a smoothly operating lift without any binding, each inner arm is pivotally connected to only one outer arm by a separate pin 52. Each pin 52 is received in a bore through both of the arms, a spacer collar 54 therebetween fixed to the outer arm, and a journal block 56 fixed to the inner arm.

Figure 6:
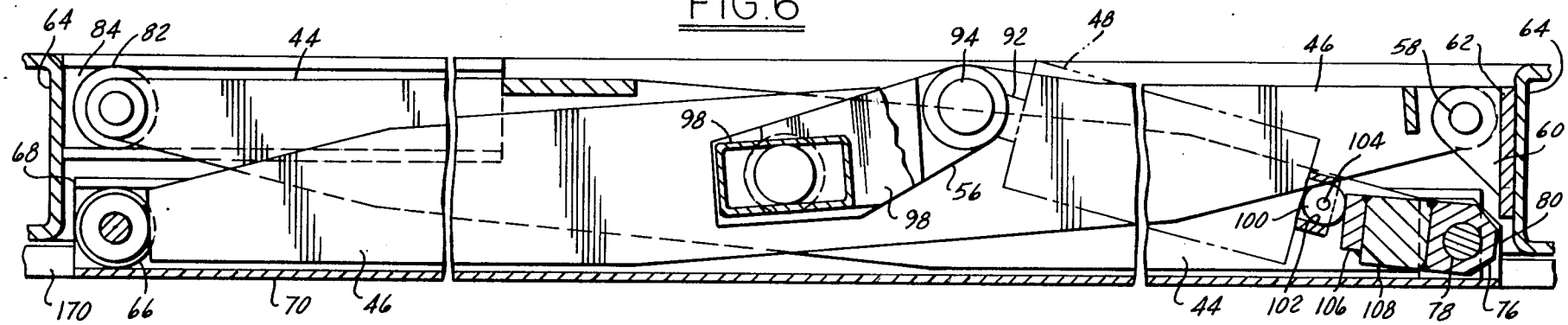
FIG. 6 is a fragmentary sectional view taken generally on line 6—6 of FIG. 3 and showing the arrangement of arms and cylinders in the fully lowered position.
Figure 7:
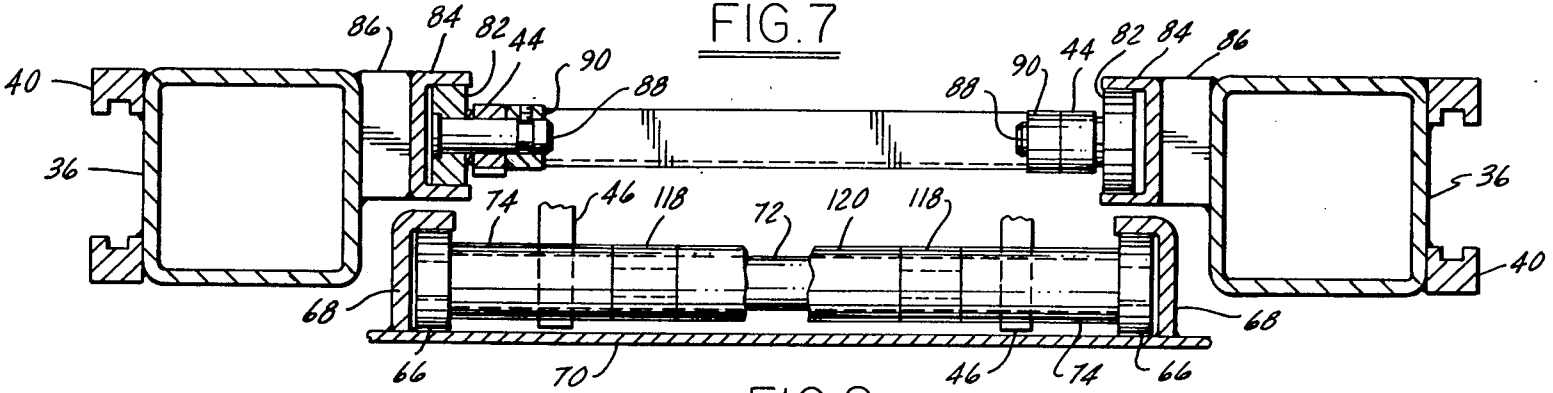
FIG. 7 is a fragmentary sectional view taken generally on line 7—7 of FIG. 3 and showing guide tracks for the arms of the lift.
Figure 8:
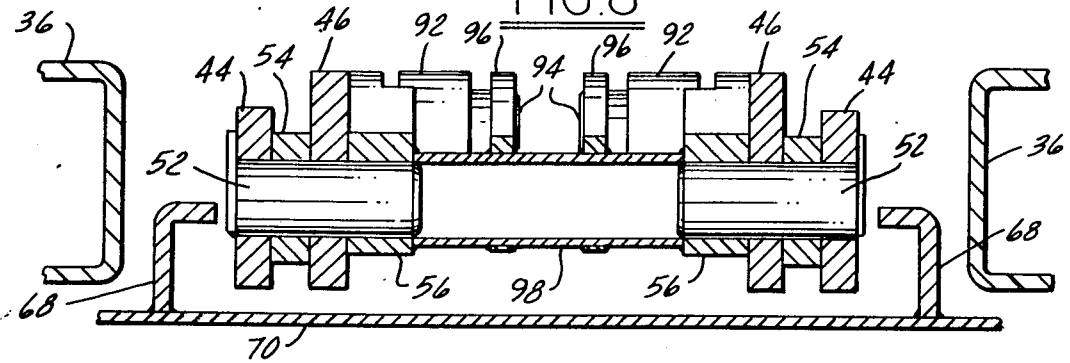
FIG. 8 is a sectional view taken generally on line 8—8 of FIG. 3 and showing pivotal connections of the arms.
Figure 10:
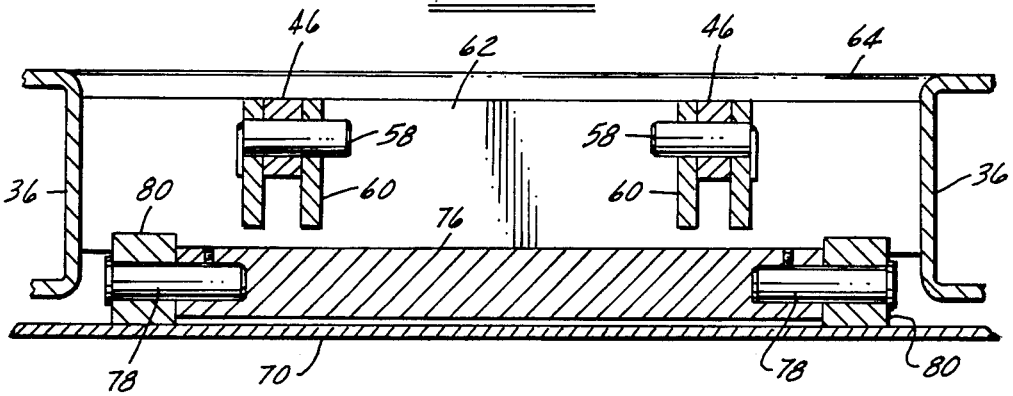
FIG. 10 is a fragmentary sectional view taken generally on line 10—10 of FIG. 3 and showing pivotal connections of the arms to the bench frame and base of the lift.

As shown in FIGS. 3 and 6, at one end each inner arm 46 is pivotally connected to the bench frame 28 and adjacent the other end is slidably connected to the base. As shown in FIGS. 6 and 10, each inner arm is pivotally connected by a pin 58 carried by brackets 60 fixed to a mounting plate 62 secured to a tubular corss member 64 extending between and welded to the rails 36 of the frame. As shown in FIGS. 6 and 7, the other end of each inner arm is slidably connected with the base by a roller 66 received in a guide track formed by a longitudinally extending L-shaped rail 68 fixed to a base plate 70. The rollers are journalled on reduced diameter portions of a shaft 72 slidably received in sleeves 74 fixed to the ends of the arms.

Similarly, as shown in FIGS. 3 and 6, at one end each outer arm 44 is pivotally connected to the base and the other end is slidably connected with the bench frame. One end of each outer arm is fixed to a carrier bar 76 which, as shown in FIG. 10, is pivotally mounted on the base by pins 78 received in brackets 80 fixed to the base plate 70. As shown in FIG. 7, the other end of each outer arm is slidably connected with the bench frame by a roller 82 received in a guide track 84 fixed to spacer blocks 86 fixed to the frame. The roller is journalled on a pin 88 received in a mounting block 90 fixed to the arm.

The guide tracks cause the rollers to move along paths parallel to each other and the axes of the longitudinal rails 36 of the bench frame. Preferably, all of the lift arms are of substantially the same length and are pivotally interconnected at substantially their midpoints.

Figure 9:
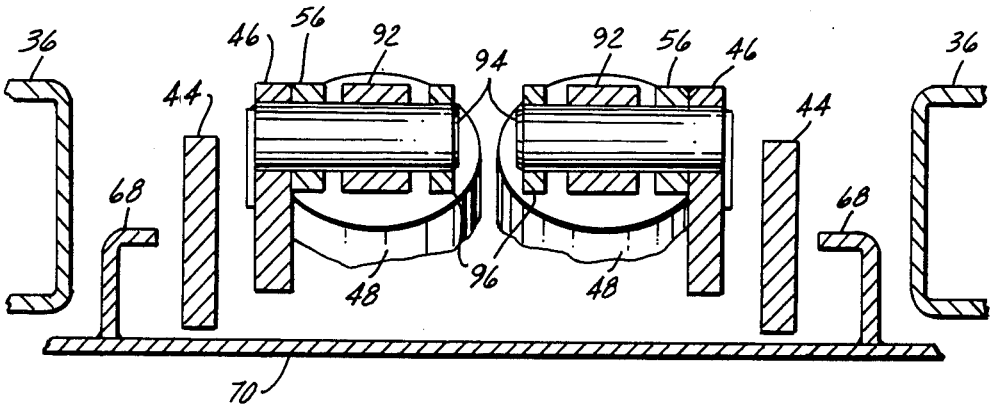
FIG. 9 is a fragmentary sectional view taken generally on line 9—9 of FIG. 3 and showing pivotal connections of the arms to the cylinders.

In accordance with this invention, to provide a compact and smoothly operating lift, cylinders 48 are received between the inner arms and connected with the inner and outer pairs of arms. As shown in FIGS. 3 and 9, the piston rod 92 of each cylinder is pivotally connected to the inner arms by a pin 94 received in a bore through an adjacent arm and its associated journal block 56 and a concentric bore through a support bracket 96 fixed to a spacer tube 98 (FIGS. 3 & 6), which extends between and is fixed to the journal blocks 56 and hence the inner arms. The body of each cylinder is pivotally mounted adjacent one end of the outer arms by a cylindrical bearing 100 received in a cavity 102 in the base of the cylinder and retained therein by pivot screws 104. Each cylindrical bearing 100 is fixed to a mounting bracket 106 secured to a spacer 108 fixed to the arm carrier bar 76.

To provide a lever for raising and lowering the lift, the piston rods are pivotally connected to the arms by the pins 94 at a point offset or spaced from a straight line through the point of the pivotal connection of the arms by the pins 52 and the point of the pivotal connection of the outer arms 44 to the base by the pins 78.

Figure 11:
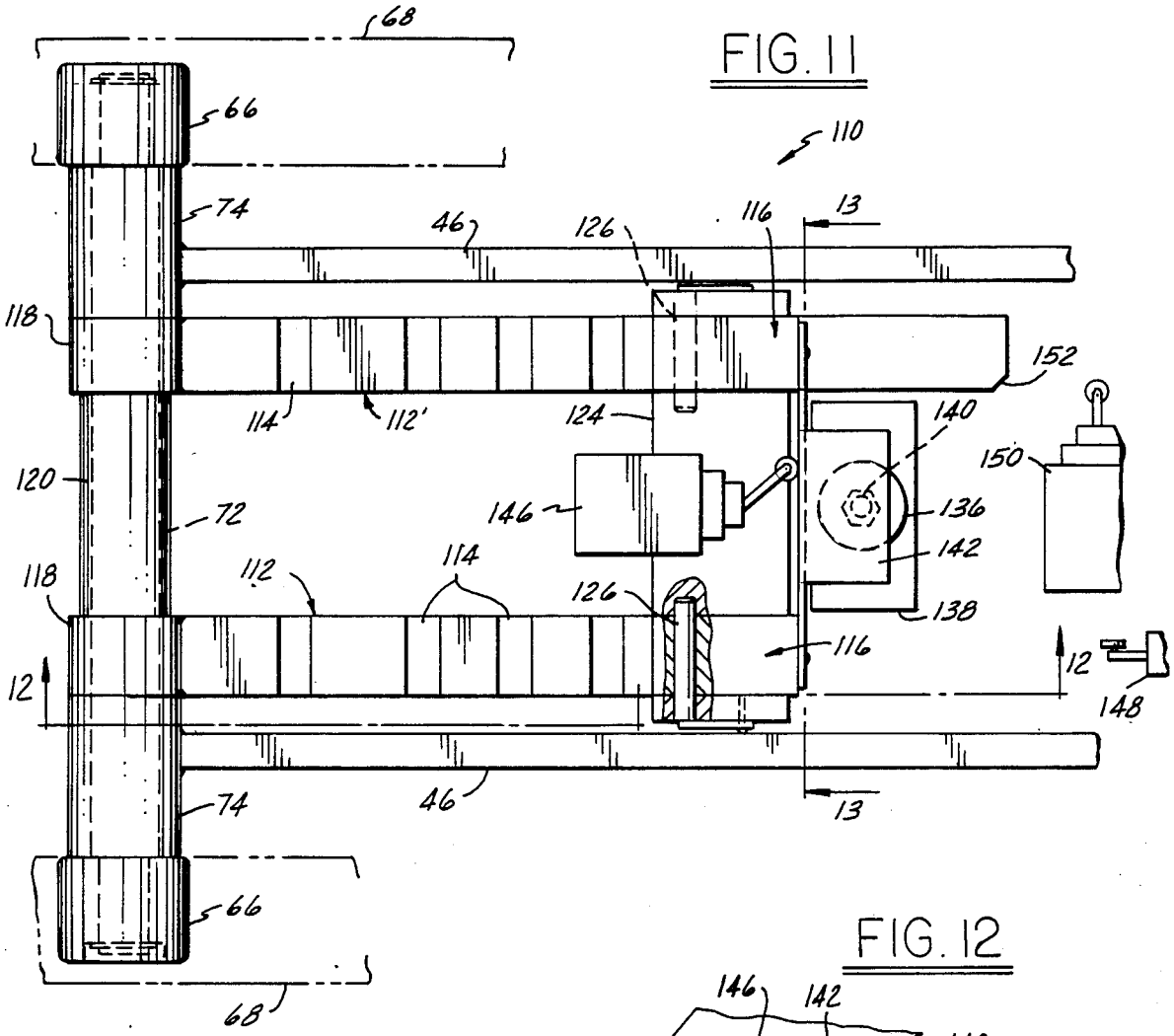
FIG. 11 is an enlarged and fragmentary plan view of a catch mechanism of the lift of FIG. 1.
Figure 12:
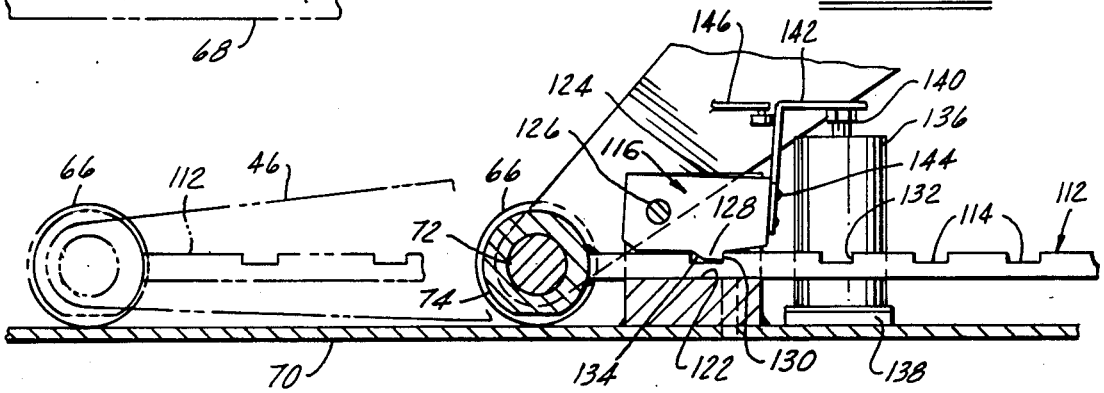
FIG. 12 is a fragmentary sectional view taken generally on line 12—12 of FIG. 11 and showing some component parts of the catch.
Figure 13:
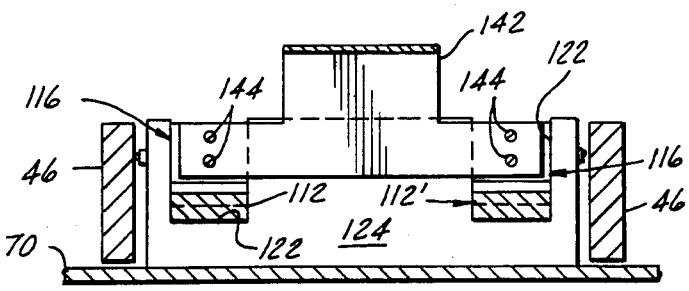
FIG. 13 is a fragmentary sectional view taken generally on line 13—13 of FIG. 1 and showing some of the component parts of the catch.

In accordance with another feature of this invention, in the event of a malfunction or failure of cylinders 48 to hold the lift in its raised position, the lift is prevented from suddenly dropping into its fully lowered position by a safety catch 110 shown in FIGS. 3 and 11. This catch has a pair of slide bars 112 and 112' each having therein a plurality of longitudinally spaced apart notches 114 engagable with a latch 116 to restrain downward movemnt or lowering of the lift 50. The slide bars are connected to the inner arms 46 through collars 118 fixed to one end of the bars and slidably received on the shaft 72 along with a spacer tube 120. As shown in FIGS. 12 and 13, each bar is slidably received in a slot 122 through a mounting block 124 fixed to the base plate 70. The latches are pivotally mounted in the slots by pins 126 carried by the block 124. To restrain downward movement of the lift, each latch has a dog 128 with a stop face 130 engagable with a side wall 132 of a notch 114 in its associated slide bar. To disengage the latch from the notch when the lift is being raised, the dog has a cam face 134 which is engaged by an edge of a notch 114 to pivotally move and lift the latch 116. The latch 116 is yieldably biased to pivotally move generally downwardly by the mass of the latch so the dog will engage in a notch of the slide bar. However, if desired, the latch can also be yieldably biased to pivotally move downwardly by a spring or the like.

To permit the lift to be lowered by the cylinders, the latches 116 are pivotally moved upwardly to disengage the dogs from the slides by a solenoid 136 secured to a mounting plate 138 fixed to the base plate 70. To lift the latches, the plunger 140 of the solenoid underlies one leg of an L-shaped bracket 142 secured to both of the latches by screws 144. To provide an indication that the latches 116 are disengaged, a limit switch 146 is tripped by the bracket 142 when the catch 110 is released.

To provide an indication that the lift is fully raised, a limit switch 148 is tripped by the free end of the slide bar 112. To provide an indication that the lift is at least partially raised to at least the lowermost intermediate position in which it can be retained by the catch 100, a limit switch 150 is tripped and retained with its contacts in a closed state by an inclined face 152 of the slide bar 112' and a side of the slide bar 112'.

Preferably, although not necessarily, the power unit 32 is portable as shown in FIG. 1. The power unit has a hydraulic pump 154 with a fluid reservoir and is driven by an electric motor 156. The pump and motor are mounted on a platform 158 of a dolly. The platform is mounted on a pair of wheels 160 and casters 162 and can be rolled around on the floor by manually pushing or pulling on a handle 162 fixed to the platform. Electric control circuitry for the unit and the lift is mounted in a control panel 166 secured to the base. Power is supplied to the control panel through an electric power cable (not shown). Flexible hoses for supplying hydraulic oil under pressure to the cylinders 48 and insulated electric wires connected to the limit switches 146, 148 and 150 of the lift are enclosed in a flexible protective shield 168 extending between the lift and the power unit.

When using the lift 50, initially it is usually in the fully lowered position with its component parts positioned as shown in FIGS. 3 & 4 and the bench frame 26 just above the floor and resting on pads 170 fixerd to the ends of the base. A vehicle 20 is positioned over the bench frame and its body is secured to the frame by clamps 24. To raise the vehicle, the up button 172 on the remote control box 34 is depressed and held down which through conventional electropneumatic control circuitry including a solenoid actuated control valve supplies hydraulic oil under pressure from pump 154 to the cylinders 48 to raise the lift. When the lift is fully raised, the slide bar 112 trips the limit switch 148 (FIG. 11) which, through conventional electrohydraulic circuitry, stops movement of the pistons of the cylinders and retains them in the raised position. The lift can also be stopped at any partially raised position by releasing the up button 172 which, through the conventional electrohydraulic circuitry, stops movement of the cylinders and retains them in their partially raised position.

From the fully raised position, the lift can be lowered by pressing the down button 174 on the remote control 34 which, through conventional circuitry, energizes the solenoid 136 to raise the latches 116 and thereby disengage the catch 100. Disengaging the catch trips the limit switch 146 which in conjunction with the closed state or depressing of the down button 174 energizies, through conventional electrohydraulic circuitry, the cylinders 48 to slowly retract their pistons and thereby lower the lift. Lowering of the lift is stopped whenever the down button 174 is released which, through the conventional electrohydraulic circuitry, stops movement of the cylinders and retains them in their position.

Preferably, but not necessarily, to prevent an appendage, such as a foot of the operator from being caught and squeezed or even crushed between the frame of the bench and the floor as the lift is being lowered, the lift automatically stops in a partially lowered intermediate position such as that shown in phantom in FIG. 5. This is accomplished by the lift bar 112' disengaging from and thereby tripping the limit switch 150, which, through the conventional electrohydraulic circuitry, interrupts and stops the lowering of the lift. Thereafter, the lift can only be further lowered if the operator simultaneously presses and holds both the down button 174 on the remote control 34 and an override switch 176 on the panel of the power unit 32. The switch 176 overrides the limit switch 150 and reenergizes the electrohydraulic circuitry to further retract the pistons of the cylinder 48 and fully lower the lift. By locating the portable unit 32 a suitable distance from the lift 50, the operator must be at a location remote from the lift in order to simultaneously actuate both the down button 172 on the remote control and override switch 176 on the power unit, thereby insuring the operator cannot have any part of his body under the bench frame or in the lift while they are being fully lowered to the floor.

When the down button 174 is released, solenoid 136 is also de-energized through conventional electric circuitry so that the latches 116 are urged downward and whenever their dogs overlie notches in the slide they will engage the side walls of the notches to restrain downward movement of the lift in the event of failure or malfunction of the cyinders 48 or the power unit 32 supplying hydraulic oil to the cylinders. In the event of a failure or malfunction while the latches are raised by the solenoid 136 and hence released, the lift is prevented from dropping by check valves 178 installed in the inlet ports of the cylinders. These check valves 178 will close whenever there is a substantial drop in the pressure of the hydraulic oil at the cylinders but will permit oil to flow out of the cylinders if there is only a slight pressure drop so that the lift can be slowly lowered. Suitable check valves 178 are commercially available from Heilmeier and Weinlein, Neumarkter St. 26, 8000 Munich 80, West Germany as HAWE type LB 1 check valves.

I claim:

1. A lift for raising and lowering a bench frame with a pair of laterally spaced apart and longitudinally extending rails comprising: a base, a first pair of arms laterally spaced apart and adjacent one end each pivotally connected to one of said base and frame and adjacent the other end each slidably connected to the other for said base and frame, a second pair of arms laterally spaced apart and adjacent one end each pivotally connected to said other of said base and frame and adjacent the other end each slidably connected to said one of said base and frame, one of said pivotal connections being fixed relative to said base and the other of said pivotal connections being fixed relative to said frame, said slide connections being movable along paths generally parallel to each other and the longitudinal axes of said rails, a first pivot pivotally connecting one of the arms of said first pair with one of the arms of said second pair adjacent their midpoints, a second pivot pivotally connecting the other of the arms of said first pair with the other of the arms of said second pair adjacent their midpoints, said first and second pivots being separate from, spaced apart from, independent of, unconnected to and coaxial with each other, a pair of fluid actuated cylinders each having a piston rod and a case and being received between said arms, one of the piston rod and case of each cylinder being pivotally connected with one of the arms of one pair of said arms and the other of the piston rod and case of each cylinder being pivotally carried by said base, at least one of the pivotal connections of each cylinder being offset from a straight line intersecting the axis of said first and second pivots at the midpoints of the arms and the axis of each pivotal connection of the other pair of arms with one of the base and frame, and all of said arms and cylinders being constructed and arranged such that they are received between and within the vertical height of the rails of the bench frame when the lift and bench frame are fully lowered.

2. The lift of claim 1 wherein said second pair of arms is received between the arms of said first pair of arms and the the pivotal connection of the case of each cylinder is adjacent the pivotal connection of said second pair of arms and is fixed relative to said second pair of arms for movement therewith.

3. The lift of claim 1 wherein said cylinders are received between said second pair of arms and they are received between the arms of said first pair of arms.

4. The lift of claim 1 wherein each slide connection comprises, a guide track fixed to one of said base and frame and a roller received in said guide track and pivotally connected to one of said arms.

5. The lift of claim 1 which also comprises a catch carried by said base, operably connected with at least one pair of said arms, constructed and arranged to releasably restrain downward movement of the lift from a raised position of the lift, spaced from and received between said arms and received between and within the vertical height of said rails of the bench frame when the lift and bench frame are fully lowered.

6. The lift of claim 1 which also comprises, a catch having a latch releasably engagable with a slide bar with one of them fixedly carried by said base and the other of them connected with one of said pair of arms for movement relative to such one of them by movement of said one pair of arms relative to said base, said latch being releasably engagable with said slide bar to restrain lowering of the lift from a raised position of the lift, said latch and slide bar being received between and spaced from said arms, and said latch and slide bar being received between and within the vertical height of said rails of the bench frame when the lift and bench frame are fully lowered.

7. The lift of claim 6 wherein said latch is pivotally carried by said base and has a dog releasably engagable with stops on said slide bar.

8. The lift of claim 7 which also comprises a solenoid constructed and arranged to disengage said dog from said stops when energized to thereby permit the lift to be lowered from a raised position.

9. The lift of claim 1 which also comprises, a portable power unit having a dolly, a hydraulic pump mounted on said dolly, an electric drive motor operably connected with said pump and mounted on said dolly, a control valve connected with said pump and carried by said dolly, and at least one flexible hose inter-connecting said fluid actuated cylinders and said control valve for supplying hydraulic oil under pressure from said pump to said cylinders to raise the lift.

10. The lift of claim 9 wherein said dolly also comprises, a handle connected thereto for manually moving the dolly.

11. The lift of claim 9 which also comprises, electric circuitry carried by said dolly for controlling said valve to raise and lower said lift and at least one electric switch mounted in a control box remote from said dolly and electrically connected with said control circuitry by flexible electric wires for energizing said control circuitry to raise and lower the lift.

* * * * *